US005265362A

United States Patent [19]

Yamaguchi

[11] Patent Number: 5,265,362

[45] Date of Patent: Nov. 30, 1993

[54] PARTING SURFACE STRUCTURE OF BULLETIN DEVICE

[75] Inventor: Kinichiro Yamaguchi, Tokyo, Japan

[73] Assignee: Artpanel Consultant Co., Ltd., Tokyo, Japan

[21] Appl. No.: 802,053

[22] Filed: Dec. 3, 1991

Related U.S. Application Data

[63] Continuation-in-part of Ser. No. 575,121, Aug. 30, 1990, Pat. No. 5,099,590.

[51] Int. Cl.[5] ..... G09F 17/00

[52] U.S. Cl. ..... 40/603; 40/574; 40/156; 16/355; 16/356; 16/261

[58] Field of Search ..... 40/156, 603, 604, 574, 40/576; 16/355, 356, 260, 261, 265, 270, 271, 272

[56] References Cited

U.S. PATENT DOCUMENTS

| | | | |
|---|---|---|---|
| 2,567,536 | 9/1951 | Wolters et al. | 16/355 |
| 2,828,842 | 4/1958 | Plumley et al. | 16/355 |
| 3,967,734 | 7/1976 | Morgan et al. | 16/216 |
| 4,673,090 | 6/1987 | Grosslen | 16/355 |
| 4,958,458 | 9/1990 | Hillstrom et al. | 40/156 |
| 5,077,924 | 1/1992 | Yamaguchi | 40/603 |
| 5,088,221 | 2/1992 | Bussiere et al. | 40/576 |

FOREIGN PATENT DOCUMENTS

| | | | |
|---|---|---|---|
| 814269 | 6/1969 | Canada | 16/355 |
| 263941 | 1/1927 | United Kingdom | 16/355 |

*Primary Examiner*—Kenneth J. Dorner
*Assistant Examiner*—Cassandra Hope
*Attorney, Agent, or Firm*—Klauber & Jackson

[57] ABSTRACT

A parting surface structure of a bulletin device having a device frame, includes an open bearing portion in the device frame, a parting surface body formed as a front face of the device frame, the parting surface body including a pivot for pivotally mounting the parting surface body in the open bearing portion, and an abutment member in the open bearing portion for preventing removal of the pivot, the abutment member being rotatable with the pivot in the open bearing portion.

5 Claims, 10 Drawing Sheets

FIG. 5
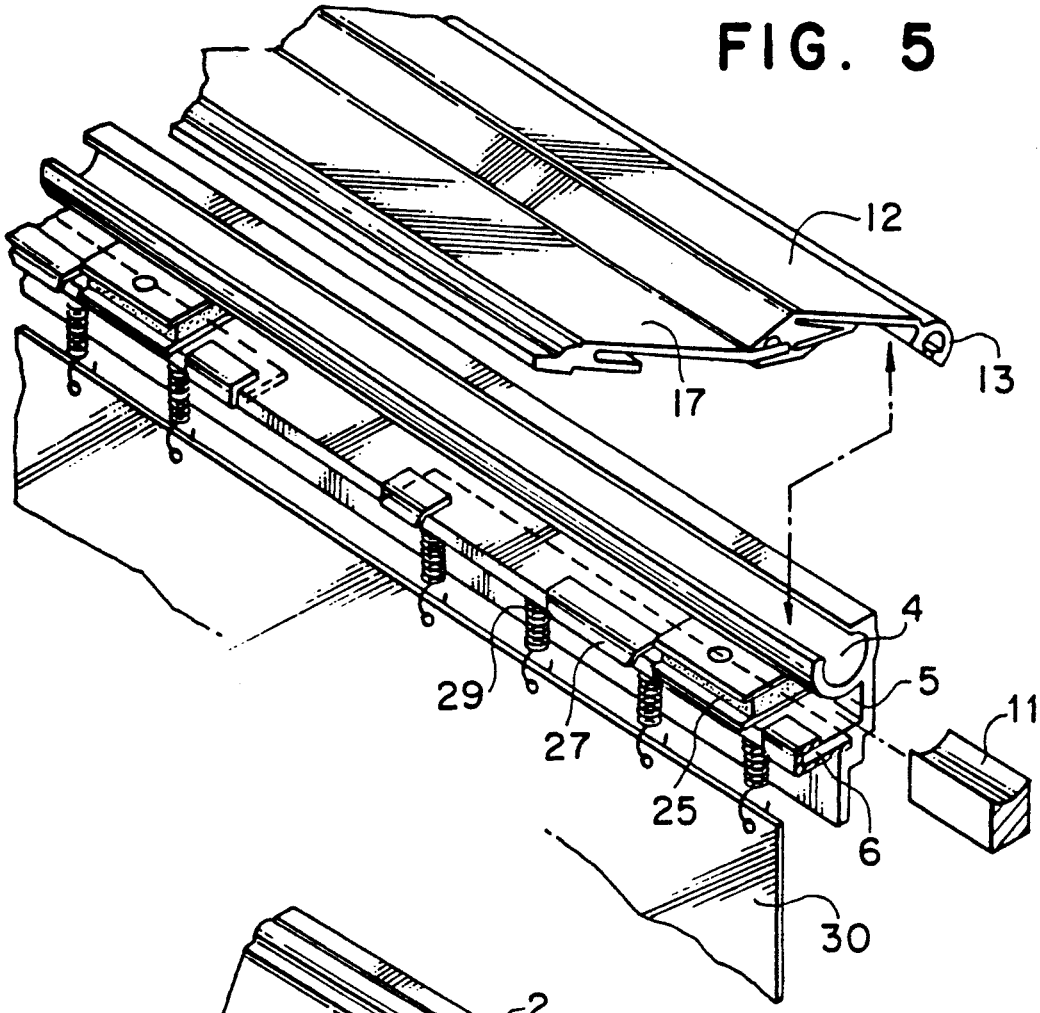
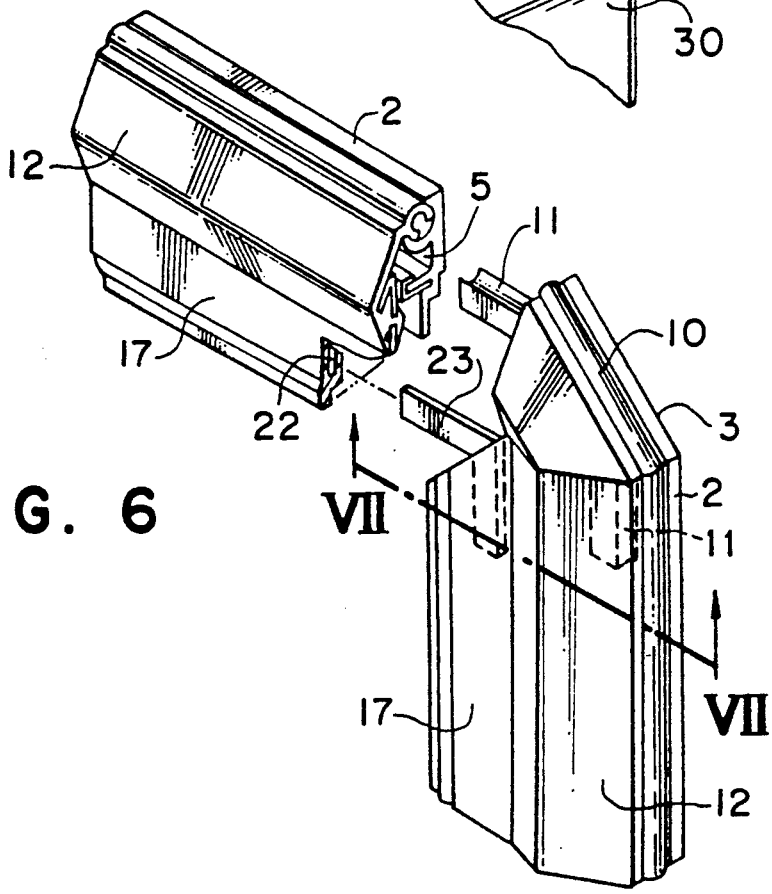
FIG. 6

PARTING SURFACE STRUCTURE OF BULLETIN DEVICE

CROSS REFERENCE TO RELATED APPLICATIONS

This application is a Continuation-in-Part of U.S. application Ser. No. 07/575,121, filed on Aug. 30, 1990, now U.S. Pat. No. 5,099,590 issued on Mar. 31, 1992, priority of which is claimed hereunder.

BACKGROUND OF THE INVENTION

The present invention relates to a bulletin device for indication or decoration in station yards, underground passages, buildings, exhibitions, etc. and more particularly to a parting surface structure wherein the width of a parting surface can be freely adjusted by replacing part of a parting portion with one having a desired parting surface width according to a bulletin to be used in a manufacturing factory or at a site where the bulletin device is mounted.

Reference is made here to an electric bulletin device proposed in Japanese Patent Application No. 59730/90 by the applicant in the present case (see FIG. 14).

According to the construction of the said proposed device, a parting surface portion which constitutes the front surface of a device frame is formed removably with respect to the device frame so that at the time of replacement of the bulletin a parting surface portion having a parting surface width suitable for the bulletin to be used can be mounted.

The above conventional device is of a construction wherein the parting surface portion constitutes the whole of the front face of the device frame, so at the time of replacement of bulletin, a bulletin to be newly used and a parting surface portion having a parting surface width suitable for that bulletin are carried up to the site where the bulletin device is mounted and then the replacement is performed.

In this case, the larger the bulletin device, the larger in size and weight of the parting surface portion to be transported. Also, the larger in size and weight of the parting surface portion, the more difficult is the replacement operation.

Besides, it is necessary to provide parting surface portions of various widths, and thus there is a problem also in the manufacture of the device.

Further, in some particular place where the bulletin device is mounted, even when there arises the necessity of fine adjustment of the parting surface width in relation to the surroundings, it is impossible to make such fine adjustment.

Also from the standpoint of effective utilization of materials, such conventional device is wasteful and disadvantageous because the whole of the parting surface portion is replaced.

SUMMARY OF THE INVENTION

The parting surface structure of the bulletin device of the present invention is characterized in that a fitting slot is formed along the inner peripheral edge of a parting surface body which forms a front face of a device frame, and a second parting surface portion having a suitable parting surface width is fitted in the said fitting slot removably. This construction brings about the following effects.

By mere replacement of the second parting surface portion which forms part of the front face of the device frame, it is possible to make adjustment into a desired parting surface width, whereby there can be attained an optimal parting effect according to the bulletin to be used.

The second parting surface portion, which is light in weight because of division, is portable and easy for replacement. It is possible for one worker to perform all the work required, including transport up to the replacement work.

In the case where the parting surface width of a bulletin to be newly used is smaller than that of the previous bulletin, it is possible to reduce the width of the second parting surface portion and make the re-use thereof. This is useful also in the aspect of effective utilization of materials, in addition to the point that the second parting surface portion is a divided part.

The present invention is also characterized in that connecting pieces are removably fitted in adjacent concave slots formed inside the edge portion of the second parting surface portion. By this construction there is attained the effect that since the second parting surface portion is mounted without difference in height, adjacent parting surfaces are flush with each other, thereby ensuring a high commercial value.

In the present invention, moreover, the second parting surface portion is made of a second parting surface material. The second parting surface material has parting edge portions different in the shape of the edge face along both sides of a plate portion having a thickness equal to the width of the foregoing fitting slots. By cutting the said plate portion suitably there can be formed a second parting surface portion having a desired width.

The construction just mentioned above can afford the following effect. According to the contents of bulletin or the surrounding atmosphere, a second parting surface portion having a selected edge face shape which is desirable designwise and also having a desired parting surface width can be obtained freely from the second parting surface material, whereby the effect of indication and decoration of the bulletin can be maximized.

The present invention is further characterized in that a parting surface body is mounted pivotably with respect to the device frame and it has a magnetic material on the inner surface thereof, while inside the device frame there are provided magnets in opposed relation to the magnetic material, so the magnetic material is attracted by the magnets whereby the second parting surface portion can be locked temporarily in a parting state and it also can be opened in an unparting state.

The construction just mentioned above can afford the following effect. By merely pivoting the parting surface body and further the second parting surface portion through the parting surface body it is possible to make change-over between an unparting state in which it is possible to effect mounting and replacement of the bulletin from the front side of the device frame and a parting state or a temporarily locked state.

The present invention is further characteristic in that magnets are mounted to a horizontal mounting portion inside the device frame with machine screws so as to be movable forward and backward and also oscillatably.

This construction brings about the following effect. Even in the case where there is a slight error in the front-rear positional relation between the magnetic material on the parting surface body side and the magnets on the horizontal mounting side, this error is eliminated by forward or backward movement or oscillation of the magnets, so the parting surface body and the second parting surface portion can be positively locked temporarily in the parted state.

BRIEF DESCRIPTION OF THE DRAWINGS

FIGS. 1 to 9 show a bulletin device according to a first embodiment of the present invention, of which:

FIG. 1 is a front view;

FIG. 2 is an enlarged vertical sectional view taken along line II—II in FIG. 1;

FIG. 3 is a partial enlarged sectional view taken along line III—III in FIG. 1;

FIG. 4 an enlarged front view of a corner portion, partially broken away;

FIG. 5 is a partial enlarged perspective view with the parting surface body and the second parting surface portion removed from the device frame;

FIG. 6 is an enlarged exploded perspective view of the corner portion;

FIG. 7 is an enlarged sectional view taken along line VII—VII in FIG. 6;

FIG. 8 an enlarged perspective view showing a stretched state of a bulletin;

FIG. 9 an enlarged vertical sectional view showing the material of the second parting surface portion;

DETAILED DESCRIPTION OF THE INVENTION

Figure 2:
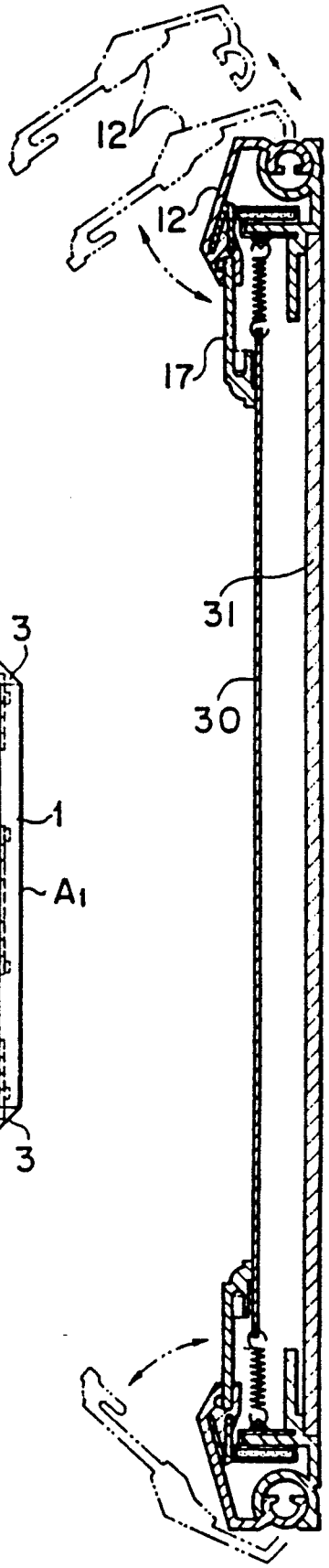
Figure 1:
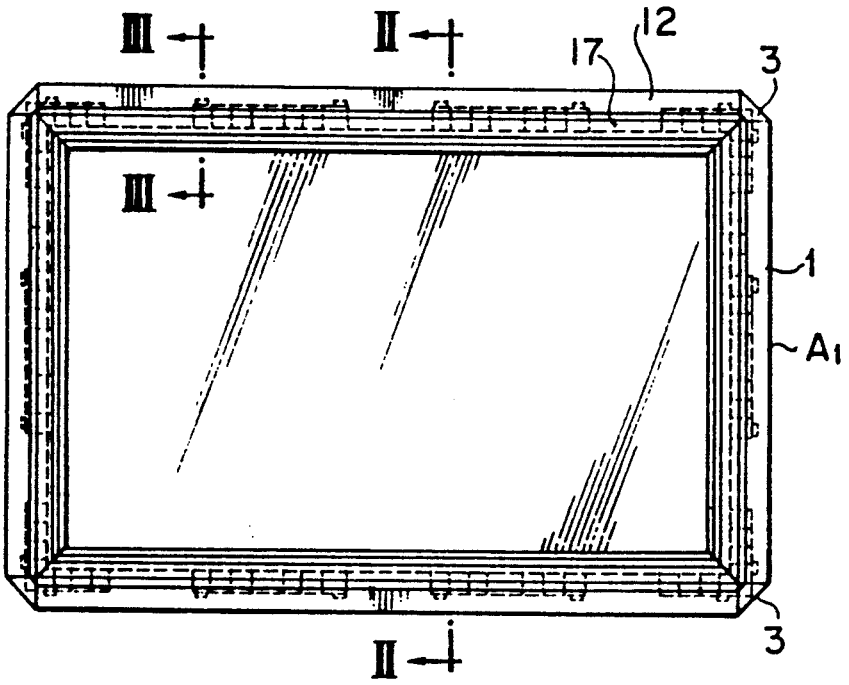
Figure 3:
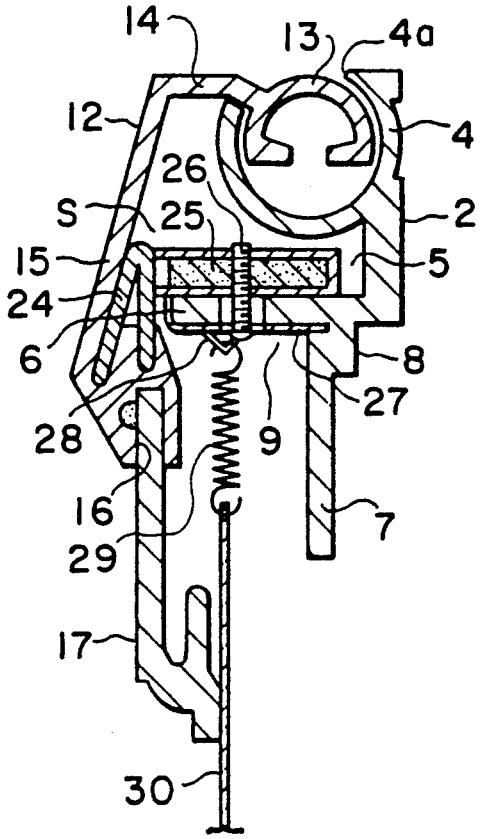
Figure 4:
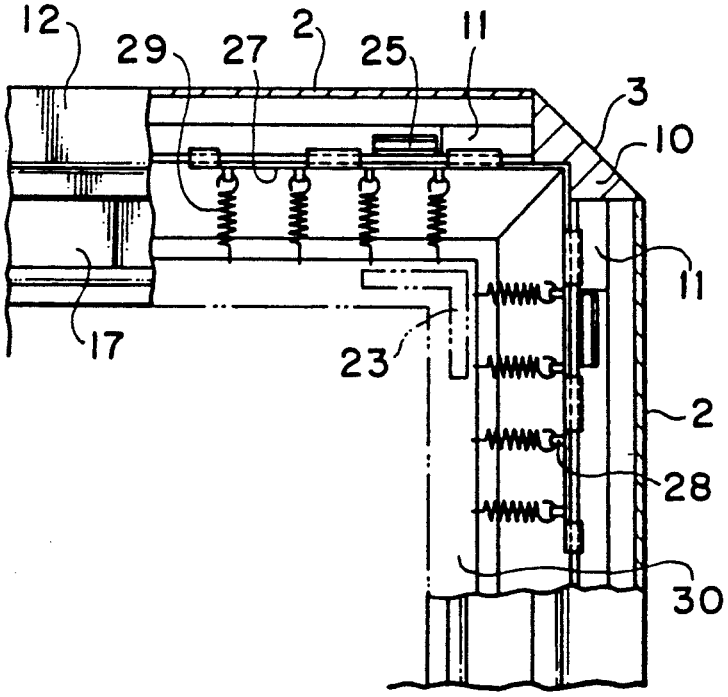
Figure 8:
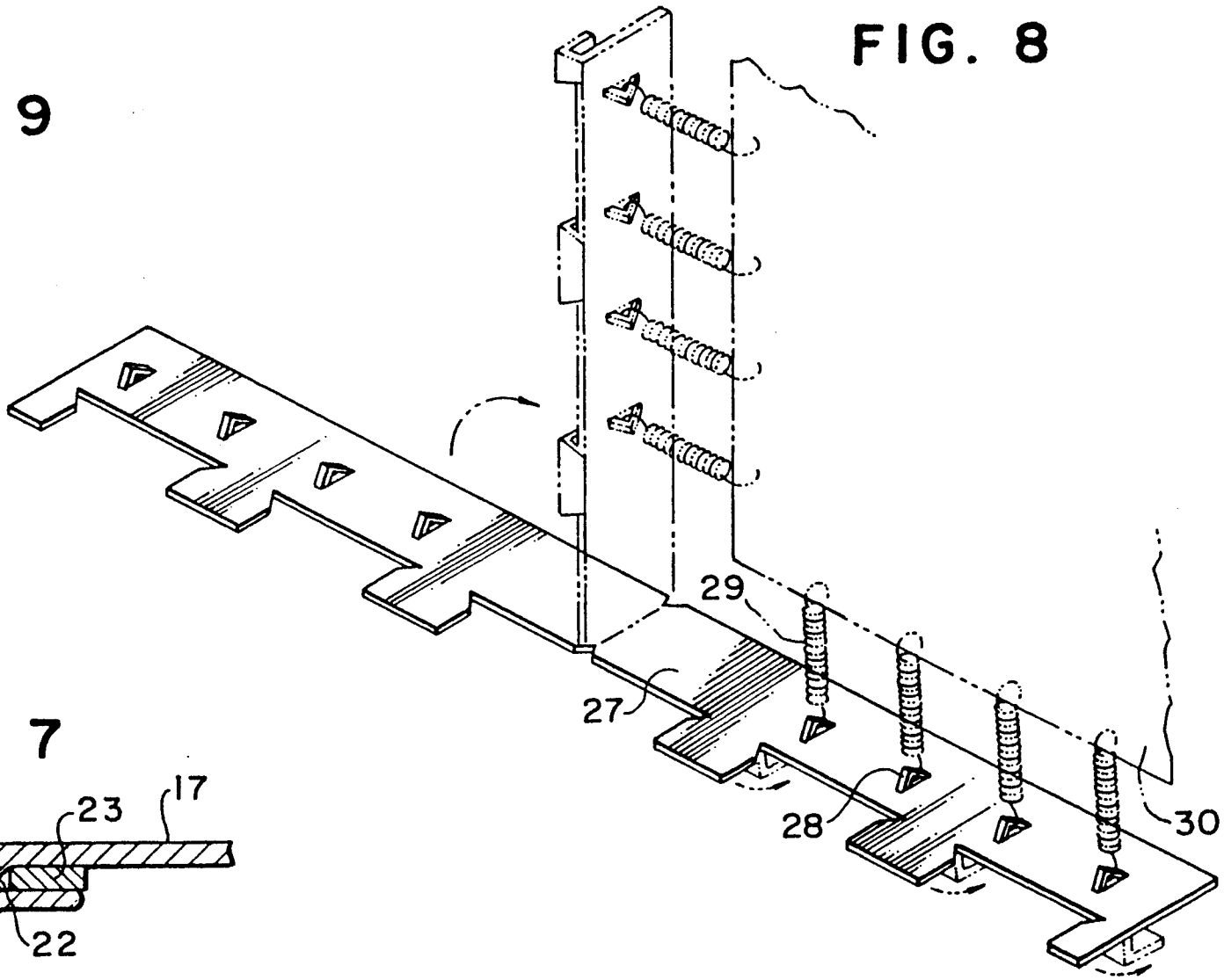
Figure 9:
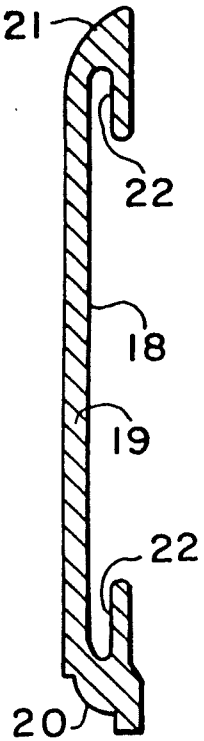
Figure 7:
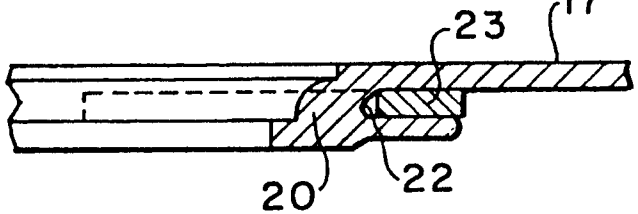

The present invention will be described in detail hereinunder with reference to the accompanying drawings.

Referring to FIGS. 1 to 9, there is illustrated a bulletin device A, according to a first embodiment of the present invention, the bulletin device $A_1$ being a laterally long, one-side bulletin type. A device frame 1 is constituted by connecting adjacent ends of edge rods 2 by a generally L-shaped connector 3, the edge rods 2 being formed by the extrusion of a synthetic resin or a light-weight metal such as aluminum into lengths corresponding to the sides of the device frame.

The edge rods 2 each include in a cross-sectional shape thereof a generally C-shaped bearing portion 4 having an outward opening 4*a*; a horizontal portion 6 overhanging to the front side and formed inside and opposedly to the bearing portion 4 to define a combination mounting space S and fitting portion 5 between it and the bearing portion 4; and a vertical portion 7 extending inwards from the back side of the horizontal portion 6 while forming a stepped part 8 on the back side and a fitting-space 9 on the front side in cooperation with the horizontal portion 6.

The connector 3, which is an integrally formed product using aluminum or a synthetic resin, has a corner portion 10 formed in conformity with the corner shape of the device frame 1 and plug portions 11, 11 extending at an angle of 90° from the corner portion 10. The edge rods 2 are connected together at an angle of 90 by inserting the plug portions 11, 11 into the fitting portions 5, 5 formed in ends of adjacent rods 2. In this construction, it is sufficient for cut sections of the end portions of the edge rods 2 to be right-angled with respect to the longitudinal direction, so that the corners are arranged without disorder. The plug portions 11, 11 of each connector 3 are fixed with bolts (not shown) within the fitting portions 5, 5 and thereby locked against dislodgement.

In each bearing portion 4 formed along the outer periphery of the device frame 1 is pivotally mounted a shaft portion 13 formed at a base end of a parting surface body 12 so that the parting surface body 12 is pivotable between the parting state and the unparting state.

The parting surface body 12, which is formed by the extrusion of a synthetic resin or aluminum, is composed in its cross-sectional shape of the shaft portion 13 formed on a rear side which is an outer side; a horizontal portion 14 extending in front of the shaft portion 13; and a parting portion 15 extending inwards from the front edge of the horizontal portion 14 so that an inner edge thereof reaches a point inside the horizontal portion of the edge rod 2.

In the inner edge of the parting portion 15 is formed a fitting slot 16, in which is stuck a second parting surface portion 17 removably, the second parting surface portion 17 having an appropriate parting surface width and also having a corner which is cut at an angle of 45°.

The second parting surface portion 17 is formed by cutting a second parting surface material 18 formed by the extrusion of a synthetic resin or aluminum, into an appropriate parting surface width.

In a cross-sectional shape of the second parting surface material 18, a stepped parting end portion 20 is formed on one side of a plate having a thickness equal to the width of the fitting slot 16, while a stepless parting end portion 21 is formed on the other side of the plate. The parting end portion which is considered preferable designwise can be chosen and cut in a desired parting surface width so that either parting end portion 20 or parting end portion 21 is selected.

The mounting and removal of the second parting-surface portion 17 are performed either in a mounted state of the parting surface body 12 to the device frame 1 or in a removed state from the device frame. For the latter, the shaft portion 13 of the parting surface body 12 has substantially a large semicircular section in which a plane portion 13*a* having a diameter smaller than the width of the opening 4*a* is formed inside the shaft surface, so that when the parting surface body 12 has been pivotally moved into the unparting state, the plane portion 13*a* of a smaller diameter is opposed to the opening 4*a*, thus permitting removal of the parting surface body 12 with respect to the bearing portion 4.

Between adjacent parting end portions 20, 20 there is disposed a generally L-shaped connecting piece 23 which is fitted removably in concave slots 22 formed on the back sides of the end portions 20, 20 so that the end portions are connected together so as to be flush with each other without difference in height.

To and along the back side of the parting portion 15 is attached a magnetic material 24 such as an iron plate for example. The magnetic material 24 is attracted by magnets 25 disposed on the side of the horizontal portion 6, whereby the parting surface body 12 and the second parting surface portion 17 are locked temporarily in the parting state.

The magnets 25 are mounted with machine screws 26 at several places along the horizontal portion 6 so as to be movable back and forth and oscillatable within the mounting space S. Even when there is a slight error in the positional relation between the magnets 25 and the magnetic material 24, all the magnets 25 come into attractive contact with the magnetic material 24, thereby affording a satisfactory temporarily-locked state.

A bulletin 30 is supported in a stretched state through coil springs 29 by means of hooks 28 of hook plates 27 disposed at several places along the horizontal portion. The stretching or replacement of the bulletin which is in the form of film is performed after pivotally moving the parting surface body 12 and the second parting surface portion 17 into the unparting state or after the removal thereof from the device frame 1.

On the back side of the device frame 1, a back plate 31 is mounted with machine screws or the like in such a manner that the peripheral edge of the back plate 31 is fitted in the stepped portion 8. By this construction it is made possible to make replacement with a second parting surface portion 17 having an optimal parting width. Also as to the replacement of the bulletin 30, a desired filmy bulletin 30 can be mounted from the front side of the device frame 1 after opening of the second parting surface portion 17 together with the parting surface body 12 or after the removal thereof from the device frame 1.

Figure 10:
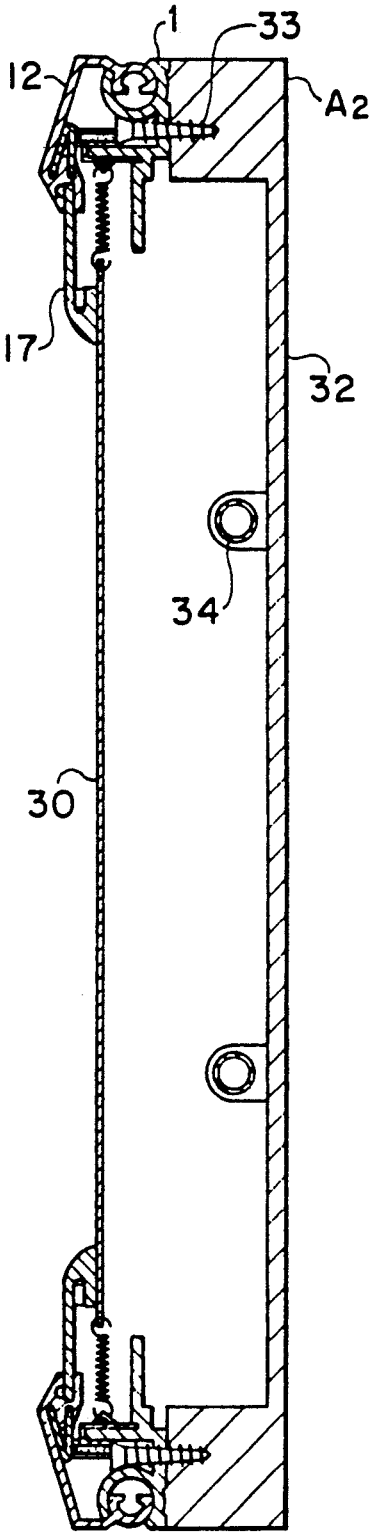
FIG. 10 is an enlarged vertical sectional view of a bulletin device according to a second embodiment of the present invention.
Figure 14:
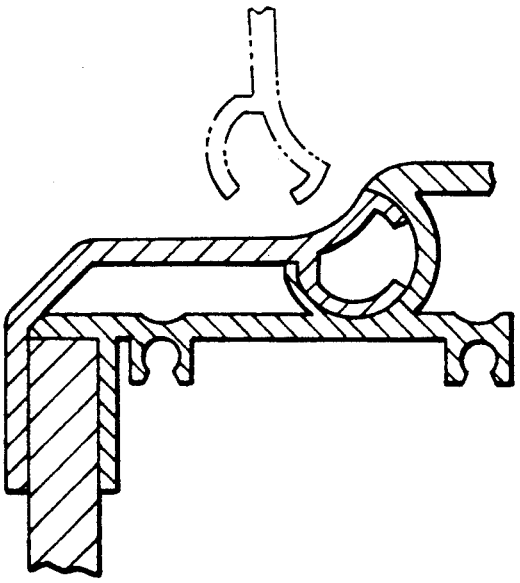
FIG. 14 is a partial enlarged sectional view showing a conventional example.

Referring now to FIG. 10, there is illustrated a bulletin device $A_2$ according to a second embodiment of the present invention, in which a light box 32 is mounted with machine screws 33 to the back of the device frame 1 in place of the back plate 31. Other constructional points are basically the same as in the first embodiment illustrated in FIG. 1, so will not be explained here.

Also in the case of the bulletin device $A_2$ which is provided with a light source 34, adjustment can be made into an optimal parting state by mere replacement to a second parting surface portion having a parting width suitable for the filmy bulletin 30, and the replacement of the bulletin 30 can be done from the front side of the device frame 1 after opening the second parting surface portion 17 together with the parting surface body 12 or after removal thereof from the device frame 1.

Figure 11:
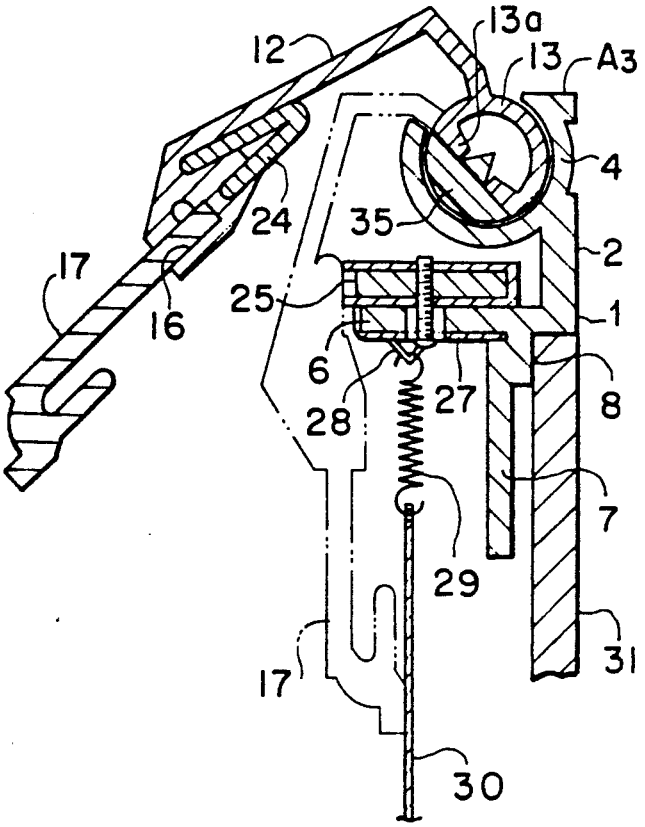
FIG. 11 is a partial enlarged sectional view of a bulletin device according to a third embodiment of the present invention.

Referring now to FIG. 11, there is illustrated a bulletin device $A_3$ according to a third embodiment of the present invention, in which an abutment member 35 of a generally small semicircular section is contacted with and along the plane portion 13*a* of a small diameter of the shaft portion 13 of the parting surface body 12 so that the parting surface body 12 cannot be removed from the device frame 1. Other constructional points are basically the same as in the first embodiment illustrated in FIG. 1, so will not be explained here.

According to the bulletin device $A_3$, replacement can be made to a second parting surface portion 17 having an optimal parting width in accordance with the degree of parting of the filmy bulletin 30 used. Also, replacement of the bulletin 30 can be done from the front side of the device frame 1 after opening the second parting surface portion 17 together with the parting surface body 12.

Figure 12:
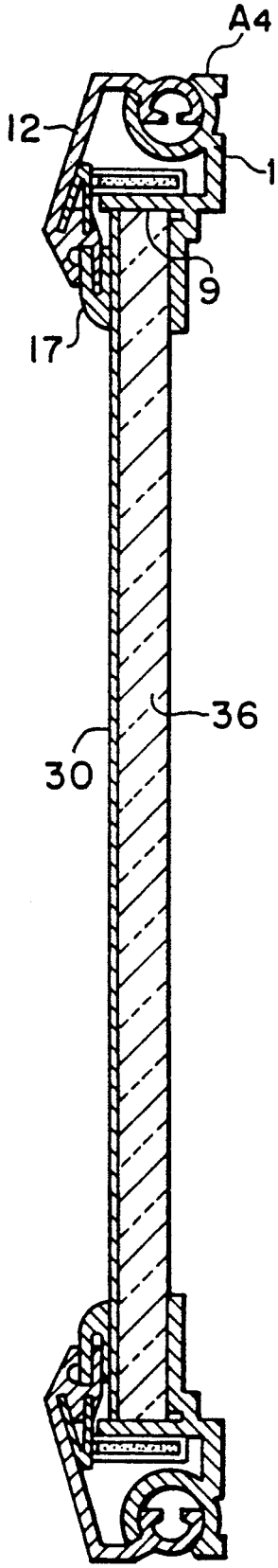
FIG. 12 is an enlarged vertical sectional view of a bulletin device according to a fourth embodiment of the present invention.

Referring now to FIG. 12, there is illustrated a bulletin device $A_4$, in which there is used a bulletin 30 provided with a base plate and having a small parting range.

The bulletin 30 provided with the base plate, indicated at 36, is removably fitted in a fitting portion 9, and parting is made by a second parting surface portion 17 having a paper strip-like parting width. In this embodiment, the base plate 36 also serves as the back plate 31, so it is not necessary to use the back plate 31. Other constructional points are basically the same as in the first embodiment illustrated in FIG. 1, so the explanation thereof will be omitted.

According to the bulletin device $A_4$, replacement to a second parting surface portion 17 having an optimal parting width can be done in accordance with the degree of parting of the bulletin 30 provided with the base plate 36. Also as to the replacement of the bulletin 30 with the base plate 36, it can be done from the front side of the device frame 1 after opening the second parting surface portion 17 together with the parting surface body 12 or after the removal thereof from the device frame.

Figure 13:
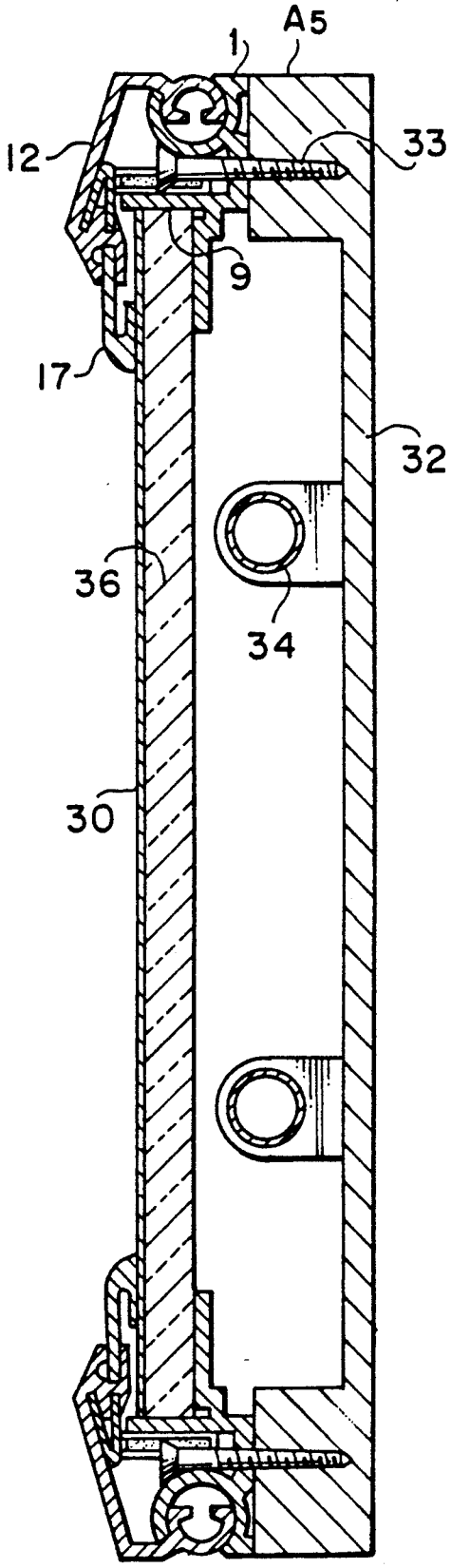
FIG. 13 is an enlarged vertical sectional view of a bulletin device according to a fifth embodiment of the present invention.
Figure 15:
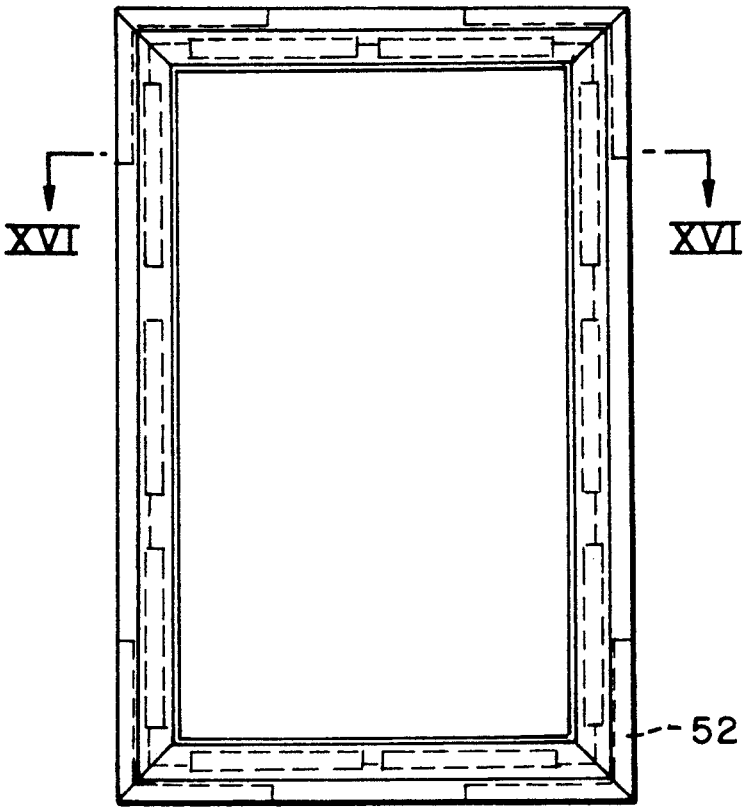
FIG. 15 is a front view of a bulletin device according to another embodiment of the present invention.
Figure 16:
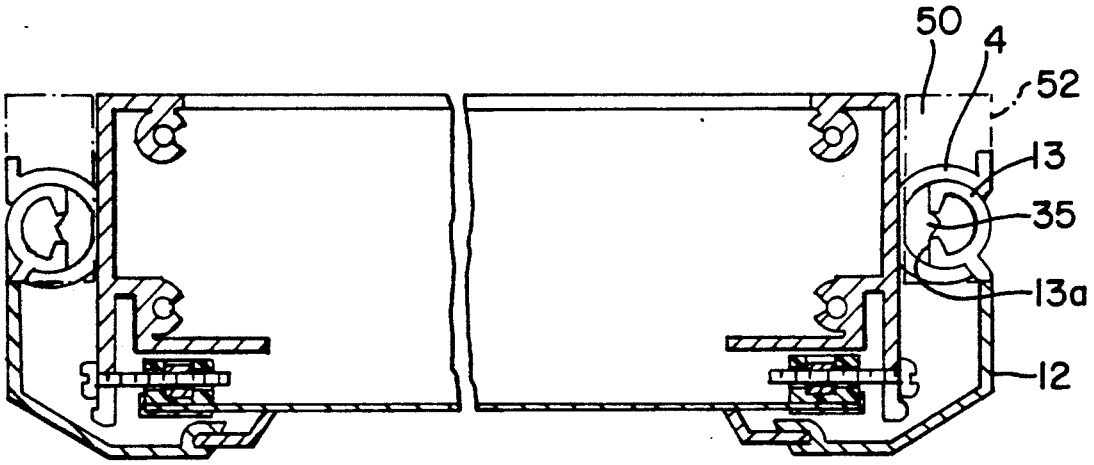
FIG. 16 is a partially enlarged cross-sectional view of the bulletin device of FIG. 15, taken along line XVI—XVI thereof.
Figure 17:
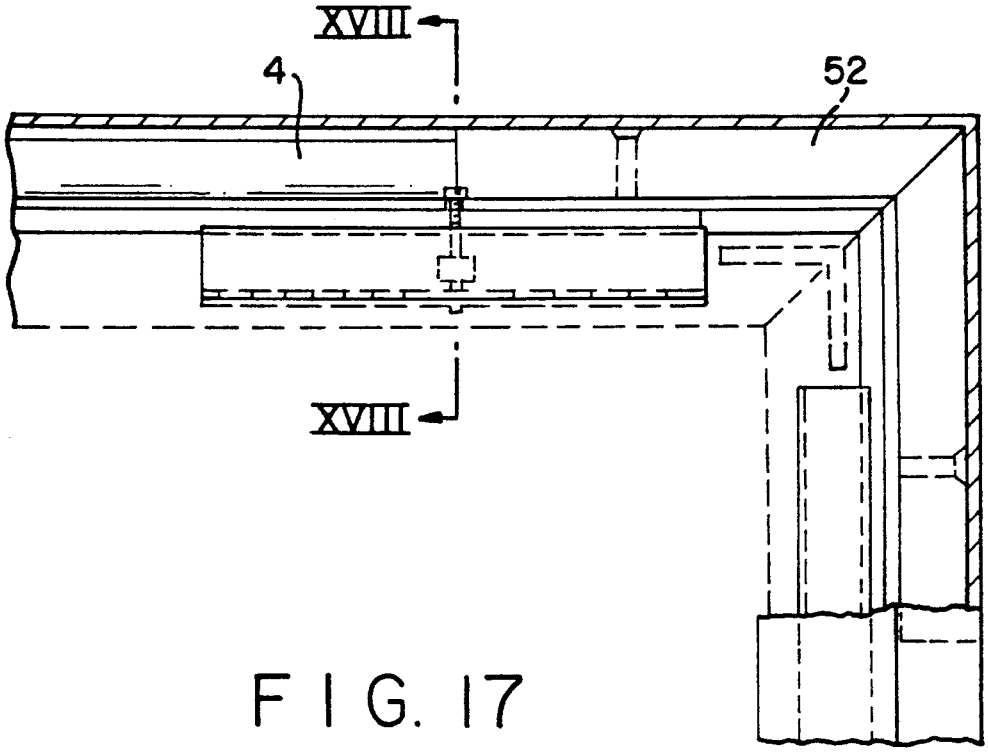
FIG. 17 is a partially enlarged and broken front view of the corner portion of the bulletin device of FIG. 15.
Figure 18:
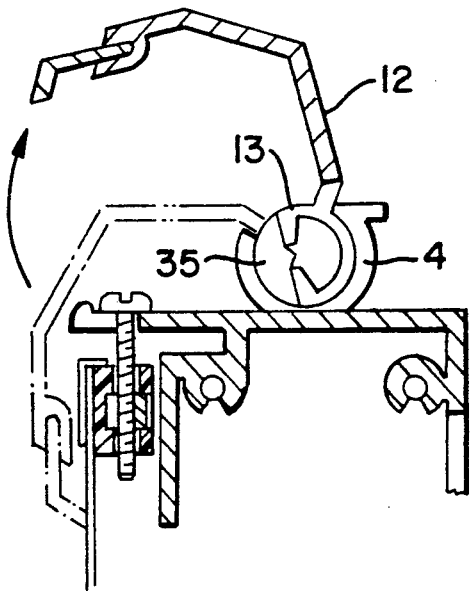
FIG. 18 is an enlarged cross-sectional view of the bulletin device of FIG. 17, taken along line XVIII—XVIII thereof.
Figure 19:
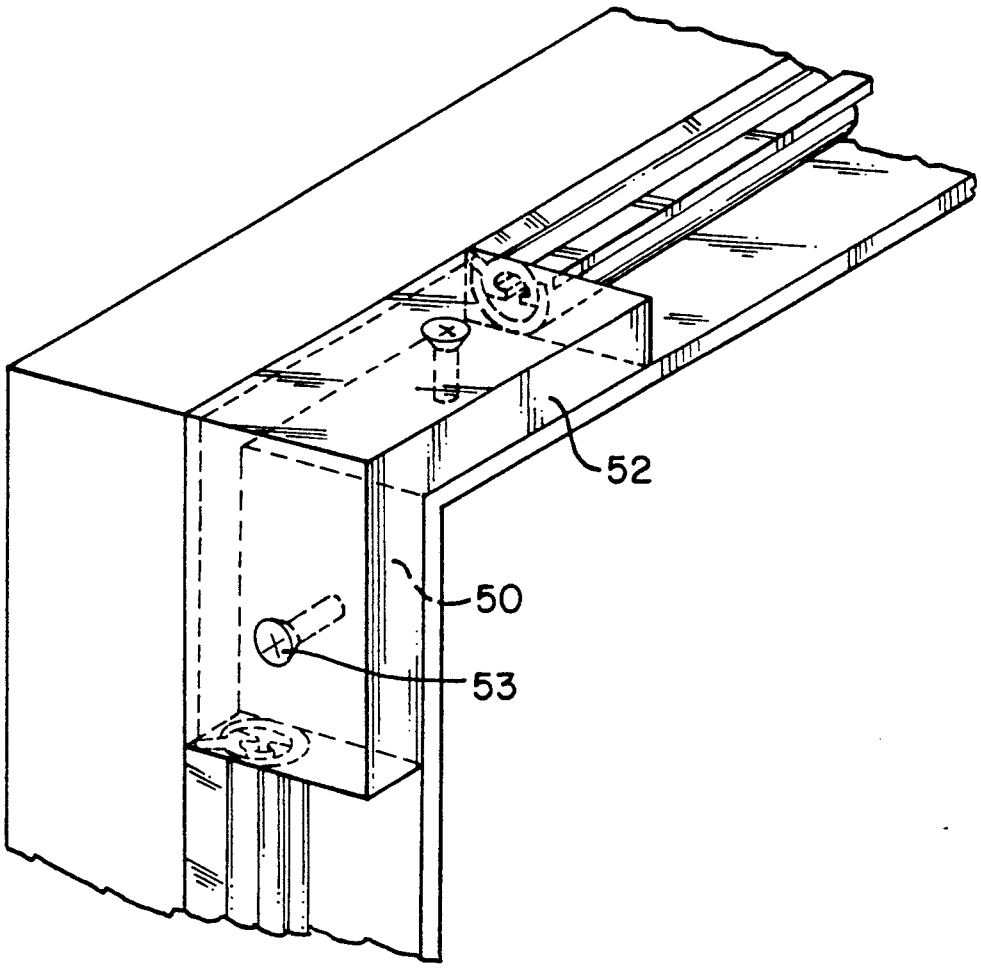
FIG. 19 is an enlarged perspective view of the rear side of the corner portion thereof.
Figure 20:
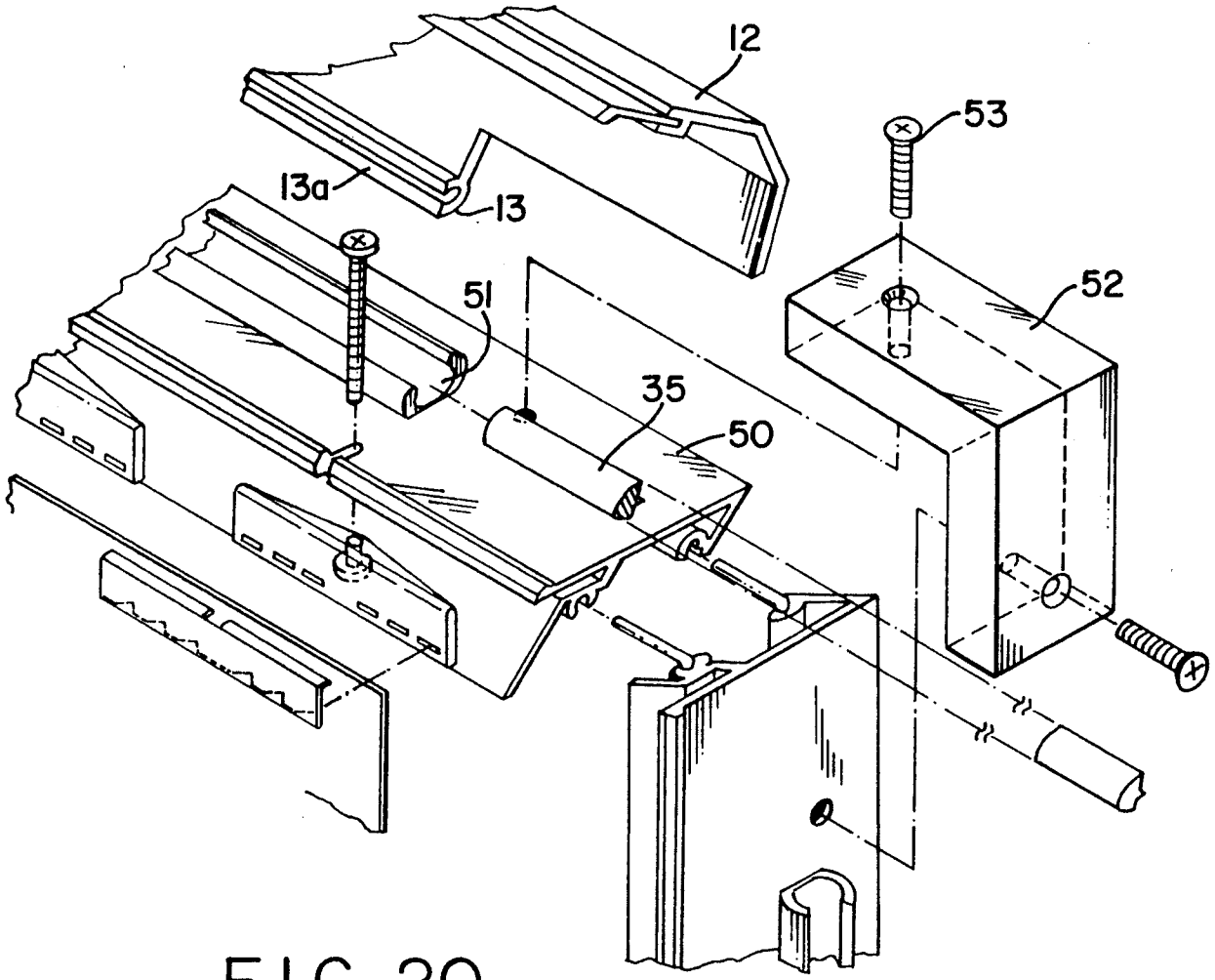
FIG. 20 is an enlarged exploded perspective view of the front side of the corner portion thereof.

In a bulletin device $A_5$ illustrated in FIG. 13, which is provided with a light transmitting-base plate 36, a bulletin 30 having a medium degree of parting range is fitted in a fitting portion 9, and a light box 32 is attached to the back of the device frame 1 with machine screws 33. Other constructional points are basically the same as in the first embodiment illustrated in FIG. 1, so the explanation thereof will be omitted.

According to the bulletin device $A_5$, replacement can be made to a second parting surface portion 17 having an optimal parting width in accordance with the degree of parting of the bulletin 30 with the base plate 36. Also as to the replacement of the bulletin 30, it can be done from the front side of the device frame 1 after opening the second parting surface portion 17 together with the parting surface body 12 or after the removal thereof from the device frame 1. Also in this state it is possible to make replacement of the light source 32 in the light box 32.

Referring now to FIGS. 15–20, a bulletin device according to another embodiment of the present invention is shown in which elements corresponding to those of the bulletin device of FIGS. 1–14 are identified by the same reference numerals, and a detailed description thereof will be omitted herein for the sake of brevity.

In the aforementioned embodiments of the invention, it was possible to alternatively select two modes of operation. In the first mode of operation, an abutment member 35 having a substantially semi-circular sectional view is detachably inserted into the C-shaped bearing portion 4 of device frame 1. When abutment member 35 is inserted into the plane portion 13*a* of shaft portion 13 in bearing portion 4, first parting surface body 12 cannot be removed from the bearing portion 4. In the second mode of operation, the first parting surface body 12 is removable from bearing portion 4 when abutment member 35 is pulled out from bearing portion 4.

In the bulletin device of FIGS. 15–20, the above alternative modes of operation are possible after completion of installation of device frame 1.

Specifically, the corner of device frame 1 is partially cut off so as to provide an opening 51 in the end of bearing portion 4 at the cut-off portion 50. As a result, it is possible to pull out the abutment member 35 from opening 51 or to insert abutment member 35 into opening 51. A substantially L-shaped cover 52 is fixed on bearing portion 4.

Although the bulletin devices of the above embodiments are a one-sided bulletin type, no limitation is made thereto, and the bulletin device of the invention may be a double-sided bulletin type. Further, the parting surface body 12 may be of a type incapable of being opened and closed; in other words, it may be formed in one piece with the device frame 1 or fixed thereto integrally. These modifications do not alter the gist of the present invention at all.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope or spirit of the invention as defined by the appended claims.

What is claimed is:

1. A parting surface structure of a bulletin device having a device frame, comprising:

an open bearing portion in said device frame, a parting surface body which is formed as a front face of said device frame, said parting surface body including pivot means for pivotally mounting said parting surface body in said open bearing portion, and restrainment means in said open bearing portion for preventing removal of said pivot means wherein said device frame has a corner thereof which is cut away so as to define opening means for removing and inserting said restrainment means in said open bearing portion after said device frame has been installed.

2. A parting surface structure according to claim 1, wherein said restrainment means includes an abutment member in said open bearing portion, said abutment member being rotatable with said pivot means in said open bearing portion.

3. A parting surface structure according to claim 2, wherein said open bearing portion has a substantially C-shaped cross-sectional configuration, said pivot means has a substantially semi-circular cross-sectional configuration, and said abutment member has a substantially semi-circular cross-sectional configuration.

4. A parting surface structure according to claim 1, further including cover means securable on said bearing portion for covering said opening.

5. A parting surface structure according to claim 1, wherein said restrainment means does not impede pivotal movement of said parting surface body with said pivot means.

* * * * *